US011384516B1

(12) United States Patent
Alexander et al.

(10) Patent No.: US 11,384,516 B1
(45) Date of Patent: Jul. 12, 2022

(54) SHOWER WATER SAVER

(71) Applicants: Tom Alexander, Corona, CA (US); M. Randall Jones, Corona, CA (US)

(72) Inventors: Tom Alexander, Corona, CA (US); M. Randall Jones, Corona, CA (US)

( * ) Notice: Subject to any disclaimer, the term of this patent is extended or adjusted under 35 U.S.C. 154(b) by 0 days.

(21) Appl. No.: 17/342,348

(22) Filed: Jun. 8, 2021

(51) Int. Cl.
*E03C 1/04* (2006.01)
*E03B 1/04* (2006.01)
*A47K 3/28* (2006.01)

(52) U.S. Cl.
CPC ..... *E03B 1/042* (2013.01); *A47K 3/281* (2013.01); *E03B 1/048* (2013.01); *E03C 1/0408* (2013.01); *E03B 2001/045* (2013.01)

(58) Field of Classification Search
CPC ..... E03B 1/042; E03B 1/048; E03C 1/0408; A47K 3/281
See application file for complete search history.

(56) References Cited

U.S. PATENT DOCUMENTS 5,862,544 A * 1/1999 Placencia ..... E03C 1/02 4/597
9,462,885 B2 * 10/2016 Cohen ..... A47B 96/02
9,808,126 B2 * 11/2017 Chiu ..... B05B 15/62
10,358,802 B2 * 7/2019 Chiu ..... E03C 1/06
10,676,931 B2 * 6/2020 Parra ..... E03C 1/00
2013/0025686 A1 * 1/2013 Norton ..... E03B 1/042 137/1
2013/0048104 A1 * 2/2013 Li ..... E03B 1/048 137/386
2016/0175872 A1 * 6/2016 Hagon ..... A47K 3/281 4/605
2018/0271336 A1 * 9/2018 Mingo ..... A47K 7/024
2020/0181891 A1 * 6/2020 Mesiemore ..... A47K 3/281
2020/0398288 A1 * 12/2020 Chiu ..... B05B 14/00

FOREIGN PATENT DOCUMENTS

WO WO-2020060464 A1 * 3/2020 ..... E04F 19/08

* cited by examiner

*Primary Examiner* — Kevin F Murphy
(74) *Attorney, Agent, or Firm* — Quickpatents, LLC; Kevin Prince

(57) ABSTRACT

A water saving apparatus for use in a shower stall that has shower walls and a handheld shower head includes a basin having a rear wall, two side walls, a front wall, a bottom wall, and a top wall. All of the walls defines an internal volume. The front wall is open to accept the handheld shower head therethrough. A drain pipe is fixed through the basin and directed to a collection point. In some embodiments, the water saving apparatus includes a side compartment for holding items such as shampoo bottles and the like. In use, with the basin mounted with the shower stall, the handheld shower head is placed into the internal volume to collect water exiting the handheld shower head and direct the water by gravity to the collection point until the water exiting the showerhead is at a desired temperature.

10 Claims, 6 Drawing Sheets

SHOWER WATER SAVER

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to shower stalls, and more particularly to a water saving device for shower stalls.

BACKGROUND

Untold billions of gallons of water are wasted down shower drains each year while people wait for their shower water to heat-up to a desired temperature. Recirculating hot water systems can be installed to reduce the wait time, but such systems are costly to install and often require running additional pipe through walls back to the water heater.

Furthermore, even with recirculating hot water systems, there is some inefficiency in running hot water through the pipes in a residence, commercial building, or industrial building, and then back to the water heater, cooling the water along the way, 24 hours a day.

Therefore, there is a need for a device that can capture the cold water that first exists the shower head in a shower and saves it for other use, such as watering plants or trees. Such a needed device would be relatively inexpensive to manufacture, and could be added during construction or after construction without nearly the complexity of installing a hot water recirculating system. Such a needed invention would further provide additional shower storage for shampoo bottles, and the like, and could be mounted to a shower wall or within a shower wall as desired. The present invention accomplishes these objectives.

SUMMARY OF THE INVENTION

The present device is a water saving apparatus for use in a shower stall that has shower walls and a handheld shower head. A basin has a rear wall, two side walls, a front wall, a bottom wall, and a top wall. All of the walls defines an internal volume. The front wall is open at a top portion of the basin and sized to accept the handheld shower head therethrough.

A drain pipe is fixed through the basin proximate the bottom wall and directed to a collection point that is lower than the basin. The drain pipe may be made from a combination of pipe segments and pipe fittings.

In use, with the basin mounted with the shower stall, the handheld shower head can be placed into the internal volume to collect water exiting the handheld shower head and direct the water by gravity to the collection point, such as a catch bucket, a garden, or the like.

In some embodiments, the basin is mounted to one of the shower walls, or preferably as in new construction or a shower remodel project, within one of the shower walls. In the preferred embodiments a depth of the basin is not more than a depth of the shower wall in which the basin is mounted, such that the basin can be mounted flush with shower tiles of the shower wall.

In some embodiments, the water saving apparatus further includes a side compartment fixed with one of the side walls of the basin. The side compartment has an open front side facing the shower stall and is adapted to receive items, such as shampoo bottles and the like.

Preferably the bottom wall is sloped towards the drain pipe such that water on the bottom wall is directed by gravity to the drain pipe. Similarly, in embodiments having the side compartment, a bottom wall of the side compartment is sloped towards the open side, such that water on the bottom wall of the side compartment is directed by gravity towards the shower stall.

The present invention is a device that captures the cold water that first exists the shower head in a shower and saves it for other use, such as watering plants or trees. The present device is relatively inexpensive to manufacture, and can be installed during new construction or as a remodel project without nearly the complexity of installing a hot water recirculating system. The present invention provides additional shower storage for shampoo bottles, and the like, and can be mounted to a shower wall or within a shower wall as desired. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
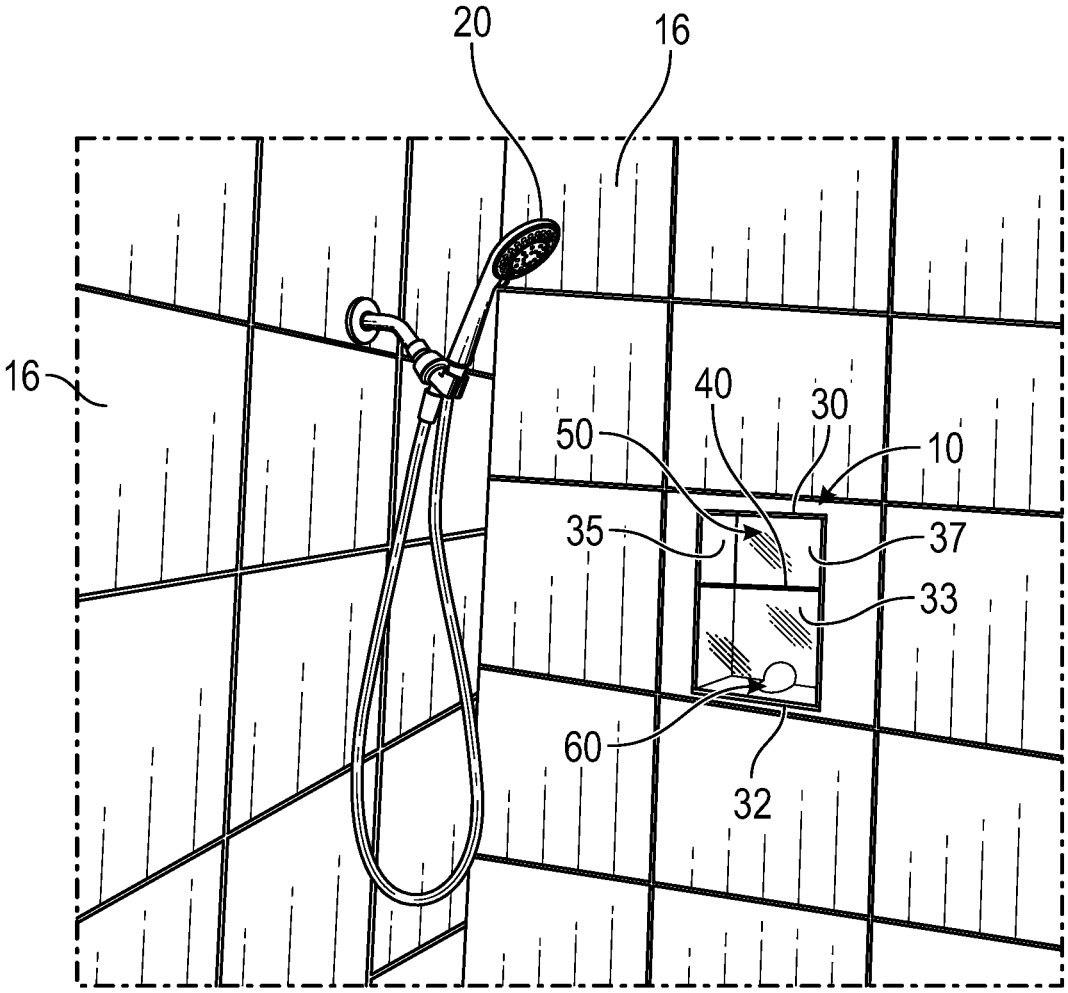
FIG. 1 is a front perspective view of the invention as mounted in a shower stall wall.
Figure 2:
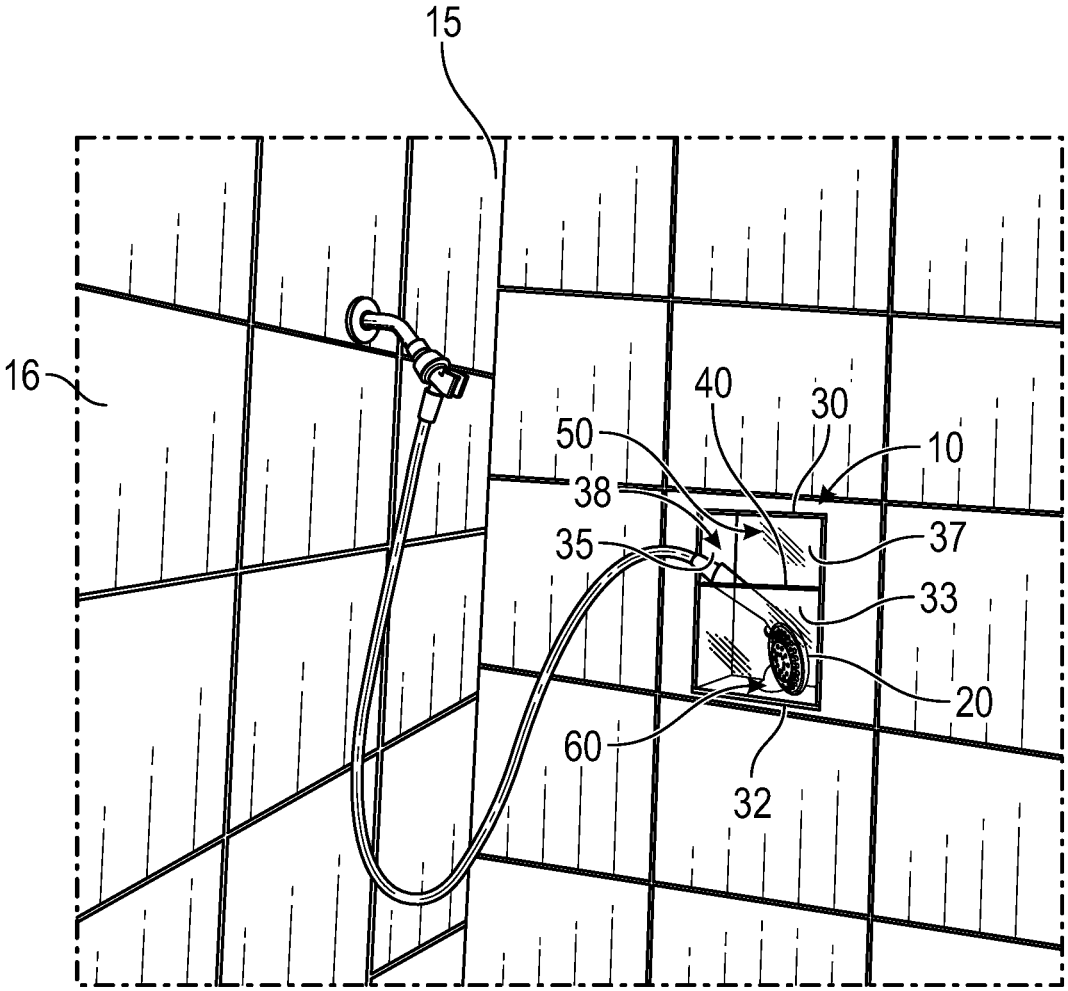
FIG. 2 is an alternate front perspective view of the invention, showing a removable shower head as held in a basin of the invention.
Figure 3:
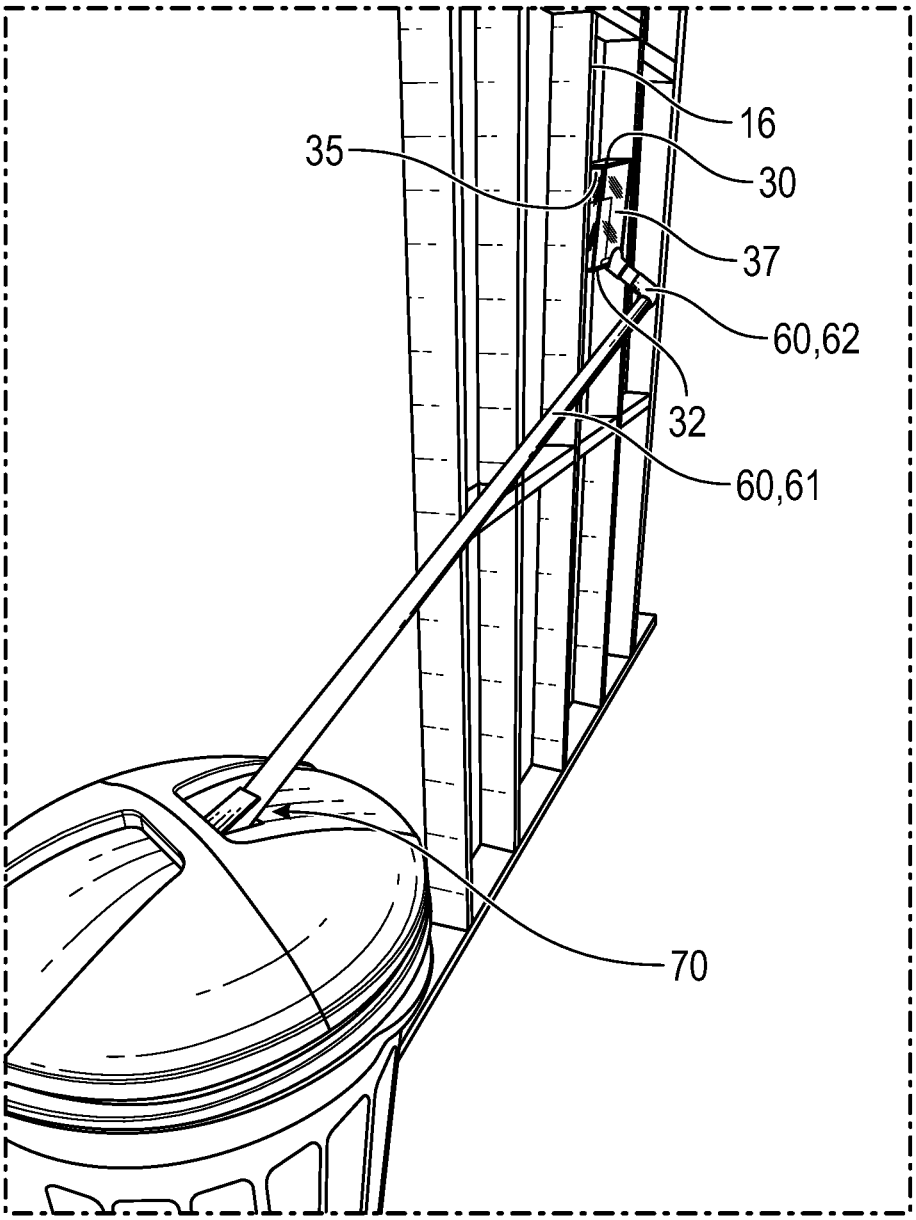
FIG. 3 is a rear perspective view of the invention, illustrated with a rear wall of the shower stall open for clarity of illustration.
Figure 4:
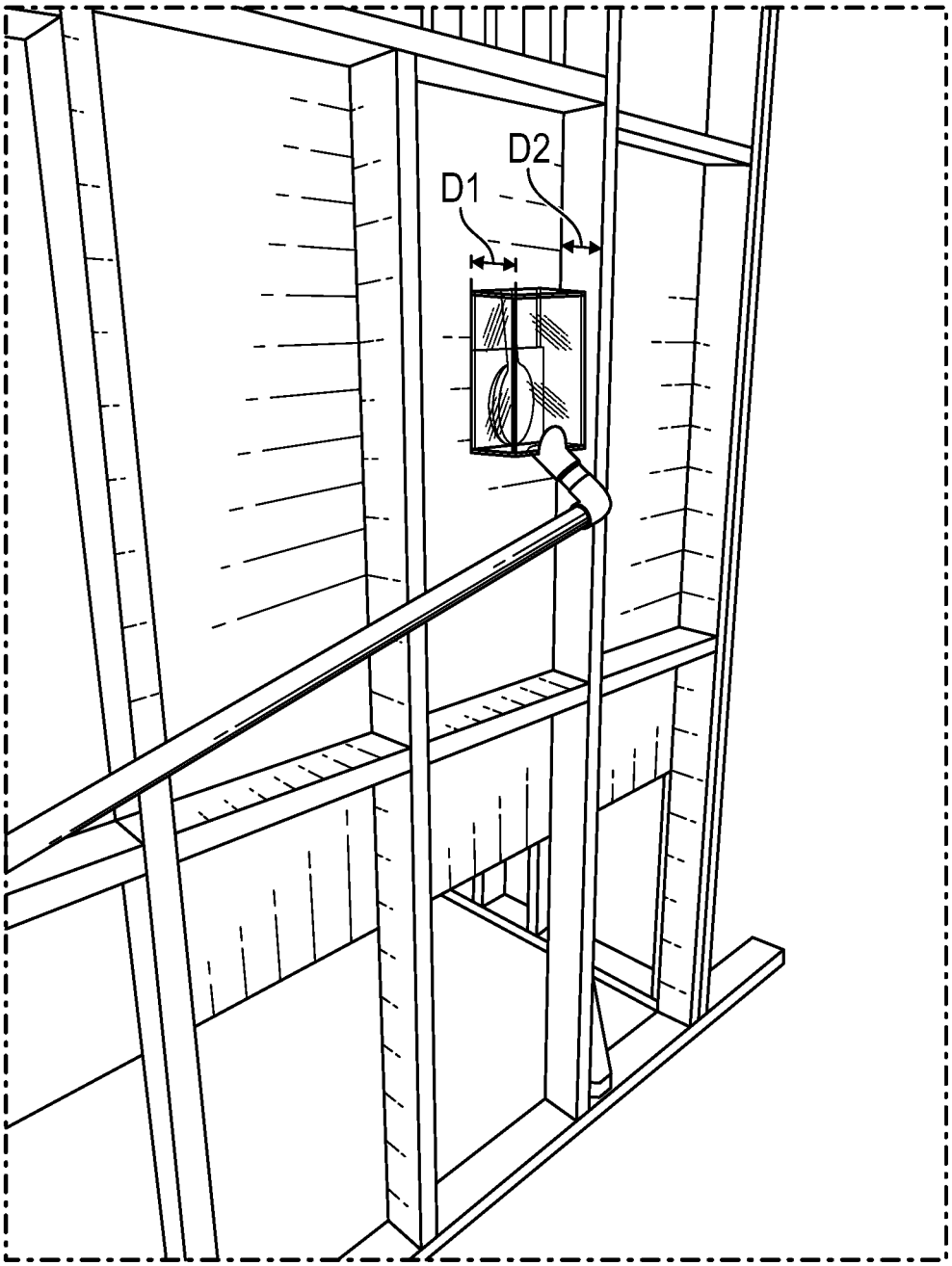
FIG. 4 is an alternate rear perspective view of the invention.
Figure 5:
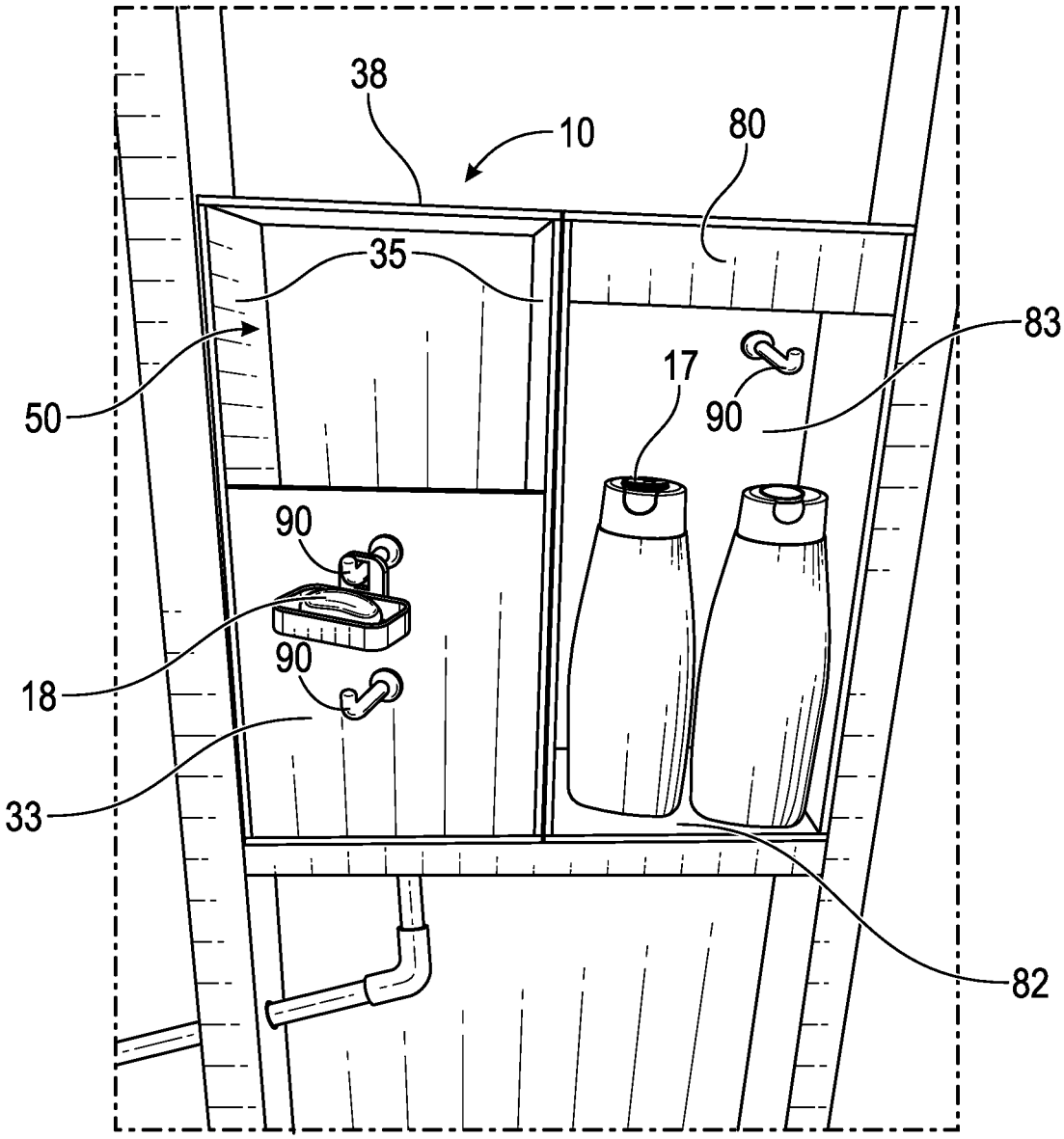
FIG. 5 is a front elevational view of a basin and a side compartment of the invention.

FIGS. 1-3 illustrate a water saving apparatus 10 for use in a shower stall 15 that has shower walls and a handheld shower head 20.

A basin 30 has a rear wall 37, two side walls 35, a front wall 33, a bottom wall 32, and a top wall 38. All of the walls 37, 35, 33, 32, 38 defines an internal volume 40. The front wall 33 is open at a top portion 50 of the basin 30 and sized to accept the handheld shower head 20 therethrough.

A drain pipe 60 is fixed through the basin 30 proximate the bottom wall 32 and directed to a collection point 70 that is lower than the basin 30. The drain pipe 60 may be made from a combination of pipe segments 61 and pipe fittings 62 (FIG. 3), such as standard PVC type pipe segments 61 and PVC type pipe fittings 62. In some installations where the shower stall 15 includes an outside wall, the drain pipe 60 is directed through the wall outside to the collection point 70 (FIG. 3). In embodiments wherein the shower stall 15 does not include an outside wall, the drain pipe 60 may need to be directed through studs until the drain pipe 60 reaches an outside wall.

In use, with the basin 30 mounted with the shower stall 15, the handheld shower head 20 can be placed into the internal volume 40 to collect water exiting the handheld shower head 20 and direct the water by gravity to the collection point 70, such as a catch bucket, a garden (not shown), or the like.

Figure 6:
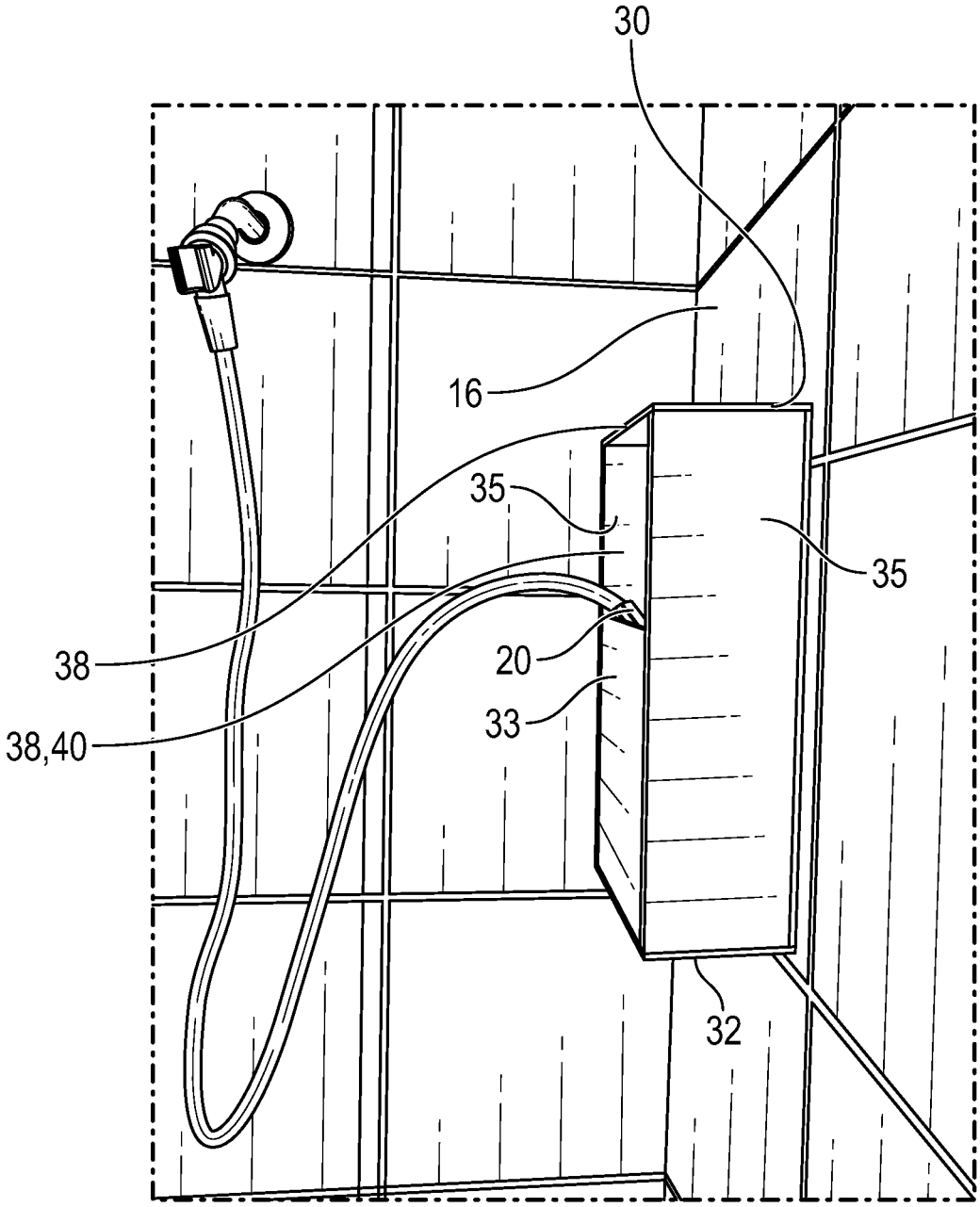
FIG. 6 is a front perspective view of an alternate embodiment of the invention wherein the basin is mounted to a shower wall, not within the shower wall.

In some embodiments, the basin 30 is mounted to one of the shower walls 16 (FIG. 6), or preferably as in new construction or a shower remodel project, within one of the shower walls 16 (FIGS. 1-5). In the preferred embodiments a depth $D_1$ of the basin 30 is not more than a depth $D_2$ of the shower wall 16 in which the basin 30 is mounted, such that the front wall 33 of the basin 30 can be mounted flush with shower tiles of the shower wall 16, the basin 30 being mounted substantially within the shower wall 16.

In some embodiments, the water saving apparatus 10 further includes a side compartment 80 (FIG. 5) fixed with one of the side walls 35 of the basin 30. The side compartment 80 has an open front side 83 facing the shower stall 15 and is adapted to receive items 17, such as shampoo bottles and the like. The basin 30 and side compartment 80 are preferably made with stainless steel in some embodiments, or alternately may be integrally formed from an injection molded plastic material, or alternately made with ceramic, porcelain, or formed with ceramic or other tiles.

Optionally one or more hooks 90 (FIG. 5) can be fixed within the side compartment 80 and on the front wall 33 of the basin 30 for hanging hangable items 18, such as razors, soap-on-a-rope soap products, or the like. In some embodiments the basin 30 and the side compartment 80 are made from a magnetically-attractive metal such as stainless steel, wherein the hooks 90 may be selectively magnetically attached to either the front wall 33 of the basin 30 or the side compartment 80, in which case the hooks 90 include a magnet (not shown).

Preferably the bottom wall 32 is sloped towards the drain pipe 60 such that water on the bottom wall 32 is directed by gravity to the drain pipe 60. Similarly, in embodiments having the side compartment 80, a bottom wall 82 of the side compartment 80 is sloped towards the open side 83, such that water on the bottom wall 82 of the side compartment 80 is directed by gravity towards the shower stall 15.

While a particular form of the invention has been illustrated and described, it will be apparent that various modifications can be made without departing from the spirit and scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A water saving apparatus for use in a shower stall having shower walls and a handheld shower head, comprising:

a basin having a rear wall, two side walls, a front wall, a bottom wall, and a top wall, all walls defining an internal volume, the front wall open at a top portion of the basin and sized to accept the handheld shower head therethrough;

a drain pipe fixed through the basin proximate the bottom wall and directed to a collection point lower than the basin; and a side compartment fixed with one of the side walls of the basin and having an open side facing the shower stall, the side compartment adapted to receive items;

whereby with the basin mounted with the shower stall, the handheld shower head can be placed into the internal volume to collect water exiting the handheld shower head and direct the water by gravity to the collection point.

2. The water saving apparatus of claim 1 wherein the basin is mounted to one of the shower walls.

3. The water saving apparatus of claim 1 wherein the basin is mounted within one of the shower walls, the basin having a depth of not more than a depth of the shower walls.

4. The water saving apparatus of claim 1 further wherein the bottom wall is sloped towards the drain pipe, whereby water on the bottom wall is directed by gravity to the drain pipe.

5. The water saving apparatus of claim 1 wherein the side compartment includes a bottom wall sloped towards the open side, whereby water on the bottom wall of the compartment is directed by gravity to the shower stall.

6. The water saving apparatus of claim 1 wherein the basin and the side compartment are integrally formed.

7. The water saving apparatus of claim 1 further including one or more hooks fixed within the side compartment for hanging hangable items.

8. The water saving apparatus of claim 1 further including one or more hooks fixed with the front wall for hanging hangable items.

9. The water saving apparatus of claim 1 wherein the drain pipe is a combination of a plurality of PVC pipes and a plurality of PVC fittings arranged to convey water from the basin to the collection point.

10. A water saving apparatus for use in a shower stall having shower walls and a handheld shower head, comprising:

a basin having a rear wall, two side walls, a front wall, a bottom wall, and a top wall, all walls defining an internal volume, the front wall open at a top portion of the basin and sized to accept the handheld shower head therethrough;

a drain pipe fixed through the basin proximate the bottom wall and directed to a collection point lower than the basin;

a side compartment fixed with one of the side walls of the basin and having an open side facing the shower stall, the side compartment adapted to receive items, the side compartment being integrally formed, the side compartment including a bottom wall sloped towards the open side, whereby water on the bottom wall of the compartment is directed by gravity towards the shower stall; and two or more hooks fixed within the side compartment and with the front wall of the basin, the hooks for hanging hangable items;

wherein the bottom wall of the basin is sloped towards the drain pipe, whereby water on the bottom wall is directed by gravity to the drain pipe;

whereby with the basin mounted within one of the shower walls, the handheld shower head can be placed into the internal volume to collect water exiting the handheld shower head and direct the water by gravity to the collection point.

* * * * *